United States Patent [19]

Christian et al.

[11] 4,324,673

[45] Apr. 13, 1982

[54] GREASE COMPOSITIONS BASED ON POLYFLUOROALKYLETHERS

[75] Inventors: John B. Christian, Yellow Springs; Christ Tamborski, Dayton, both of Ohio

[73] Assignee: The United States of America as represented by the Secretary of the Air Force, Washington, D.C.

[21] Appl. No.: 225,546

[22] Filed: Jan. 16, 1981

Related U.S. Application Data

[63] Continuation-in-part of Ser. No. 100,179, Dec. 4, 1979, abandoned.

[51] Int. Cl.[3] ..... C10M 1/32; C10M 1/50

[52] U.S. Cl. ..... 252/51.5 R; 252/58; 252/390

[58] Field of Search ..... 252/50, 51, 51.5 R, 252/390, 58; 548/330

[56] References Cited

U.S. PATENT DOCUMENTS

| | | | |
|---|---|---|---|
| 3,088,910 | 5/1963 | Rudel et al. | 252/32.5 |
| 3,242,218 | 3/1966 | Miller | 260/215 |
| 3,642,626 | 2/1972 | Christian | 252/33.6 |
| 3,665,041 | 5/1972 | Sianesi et al. | 260/615 A |
| 3,715,378 | 2/1973 | Sianesi et al. | 260/463 |
| 3,849,433 | 11/1974 | Butula | 260/308 B |
| 4,071,459 | 1/1978 | Cohen et al. | 252/51.5 R |
| 4,132,660 | 1/1979 | Christian et al. | 252/51.5 R |
| 4,185,965 | 1/1980 | Schlecht et al. | 252/51.5 R |
| 4,267,348 | 5/1981 | Tamborski et al. | 548/330 |

*Primary Examiner*—Patrick Garvin
*Assistant Examiner*—J. V. Howard
*Attorney, Agent, or Firm*—Donald J. Singer; William J. O'Brien

[57] ABSTRACT

An antirust, anticorrosion grease composition comprising a major amount of a polyfluoroalkylether base fluid, a minor amount of a fluorocarbon polymer thickening agent, and a rust and corrosion inhibiting amount of a benzimidazole.

14 Claims, No Drawings

GREASE COMPOSITIONS BASED ON POLYFLUOROALKYLETHERS

STATEMENT OF GOVERNMENT INTEREST

The invention described herein may be manufactured and used by or for the Government for governmental purposes without the payment of any royalty thereon.

CROSS REFERENCE TO RELATED APPLICATION

This application is a continuation-in-part of U.S. patent application Ser. No. 100,179 filed Dec. 4, 1979, now abandoned.

FIELD OF THE INVENTION

This invention relates to grease compositions containing additives which inhibit rust and corrosion in high humidity and high temperature environments.

BACKGROUND OF THE INVENTION

Primarily because of their thermal stability, it has been recognized that polyfluoroalkylether fluids have a great potential for use as lubricants. For example, the prior art discloses greases formulated from such fluids and thickeners such as a fluorinated copolymer of ethylene and propylene or a polymer of tetrafluoroethylene. These greases have proven to be useful as lubricants over a wide range of temperatures, e.g., as low as −40° F. and as high as 600° F. Although the greases have been found to possess superior lubricating characteristics, their utility has been limited as a lubricant for ferrous metals under conditions of high humidity and mild temperatures (below 212° F.). Their utility has also been limited by their inability to provide anticorrosion properties when employed as lubricants for ferrous metals under conditions of high temperature (above 450° F.).

In U.S. Pat. No. 4,132,660, issued to us on Jan. 2, 1979, there is disclosed a grease composition containing a perfluorinated polyalkylether base fluid and a fluorine-containing benzoxazole as a rust and corrosion inhibitor. While the patented grease composition is effective in overcoming the above-discussed problem, it would be desirable to have other greases possessing outstanding antirust and anticorrosion properties.

It is an object of this invention, therefore, to provide a new and improved grease composition based upon a polyfluoroalkylether fluid.

Another object of the invention is to provide a grease composition possessing antirust properties while lubricating ferrous metals under conditions of high humidity and mild temperatures.

A further object of the invention is to provide a grease having anticorrosion properties while lubricating ferrous metals in high temperature environments.

Other objects and advantages of the invention will become apparent to those skilled in the art upon consideration of the accompanying disclosure.

SUMMARY OF THE INVENTION

The present invention resides in the discovery that the addition of a small quantity of certain benzimidazoles to a polyfluoroalkylether base fluid and a thickener therefor provides a grease having unexpectedly outstanding properties. Thus, the resulting grease composition inhibits rust formation when utilized as a lubricant for ferrous metals under mild temperature and high humidity conditions. Furthermore, the grease inhibits corrosion when used as a lubricant for ferrous metals under high temperature conditions.

In a most specific embodiment, the present invention is concerned with a grease composition comprising (1) a major amount of a polyfluoroalkylether base fluid, (2) a minor amount of a thickener for the base fluid, and (3) a rust and corrosion inhibiting amount of a benzimidazole.

More specifically, the grease composition consists essentially of (1) about 65 to 72 weight percent of base fluid, (2) about 26.5 to 34.5 weight percent thickener, and (3) about 0.5 to 1.5 weight percent benzimidazole, based upon a total of 100 weight percent. The benzimidazoles can be used in larger amounts, but use of the larger quantities provides no added advantages. However, it is usually preferred to employ at least 1 weight percent of the benzimidazole. It has been found that when less than 1 weight percent of the additive is utilized, the grease provides less protection to ferrous metals under conditions of high humidity and mild temperature or under conditions of high temperature. The thickener can be used in smaller or larger amounts with corresponding larger or smaller amounts of the base fluid to produce softer or thicker greases without degrading the properties of the greases.

In general, any suitable polyfluoroalkylether can be used as a base fluid in formulating a grease of this invention. However, it is preferred to utilize base fluids having the following structural formulas:

$$C_3F_7O(\underset{\substack{|\\ CF_3}}{C}FCF_2O)_nR', \qquad (a)$$

in which R′ is a perfluoroalkyl group containing 2 or 3 carbon atoms, and n is an integer ranging from 5 to 50, inclusive, preferably from 10 to 40, inclusive;

$$X{-}O{-}({-}C_3F_6{-}O{-})_P(CF_2{-}O)_Q{-}({-}C_2F_4{-}O{-})_S{-}Y, \qquad (b)$$

in which $C_3F_6$ and $C_2F_4$ are perfluoroalkylene groups having the structure $$-CF_2-\underset{\substack{|\\ CF_3}}{C}F-$$

and $-CF_2-CF_2-$, respectively, and the three different perfluoroalkylene units are randomly distributed along the chain, P, Q and S are average indices of composition and only P and/or S can be zero, the sum P+Q+S has a value between 2 and 200, the ratio P/(Q+S) has a value of from 0 to 50, the ratio S/Q has a value of from 0 to 10, X and Y are terminal groups selected from the group consisting of $-CF_3$, $-C_2F_5$, $-C_3F_7$ and $$-\underset{\substack{|\\ CF_3}}{C}F-O-CF_3$$

provided that both terminal groups X and Y are $-CF_3$ when both indices P and S are equal to zero, the terminal groups are the same or different from each other and are selected from the group consisting of $-CF_3$ and $C_2F_5$ when only index P is zero, and when P is different from zero, the two terminal groups are the same or different from each other and selected from the group consisting of $—CF_3$, $—C_2F_5$ and $—C_3F_7$, or one of the terminal groups may be $$—CF_3O—\underset{\underset{CF_3}{|}}{CF}—;$$

or $$R_fO(CF_2CF_2O)_x(CF_2O)_yR_f; \quad (c)$$

in which $R_f$ is $CF_3$ or $C_2F_5$, x and y are integers whose sum is between 2 and 200 and the ratio of y to x is between 0.1 and 10.

The value of n of compound (a) is usually such that the compound has a kinematic viscosity ranging from about 18 to 320 centistokes, preferably about 270 centistokes, at 100° F. The values of P, Q, and S of compound (b) are generally such that the compound has a kinematic viscosity ranging from about 4 to 520 centistokes, preferably about 90 centistokes, at 100° F. The values of x and y of compound (c) are often such that the compound has a kinematic viscosity of about 130 centistokes at 100° F.

Perfluorinated polyalkylethers corresponding to the aforementioned formulas are commercially available compounds that are described in the literature. For a detailed description of methods for preparing the compounds, reference may be made to U.S. Pat. No. 3,242,218 for compounds corresponding to formula (a), to U.S. Pat. No. 3,665,041 for compounds corresponding to compound (b), and to U.S. Pat. No. 3,715,378 for compounds corresponding to formula (c).

As a thickener, it is usually preferred to utilize a fluorinated ethylene-propylene copolymer or polytetrafluoroethylene. The copolymer generally has a molecular weight of about 120,000 to 190,000 preferably about 140,000 to 160,000 and a density of about 2.39 to 2.47 g/cc. The polytetrafluoroethylene usually as a molecular weight of about 2000 to 50,000, preferably about 10,000 to 50,000 and a density of about 2.15 to 2.28 g/cc. These polymeric thickeners are well known materials that are described in the literature.

The benzimidazole antirust and anticorrosion additives used in the grease compositions have the following structural formula:

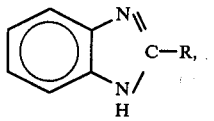

wherein R is H, hydrocarbon alkyl, hydrocarbon aryl, perfluoroalkyl or perfluoroalkyleneether. Examples of hydrocarbon alkyl and perfluoroalkyl groups include those having the formulas $C_aH_{2a+1}$ and $C_aF_{2a+1}$, respectively, where a is an integer from 1 to 10, inclusive. Examples of hydrocarbon aryl groups include phenyl, biphenyl, tolyl, xylyl, and naphthyl. Suitable perfluoroalkyleneether groups include $CF_2(OCF_2CF_2)_yOC_2F_5$, where Y is zero or an integer from 1 to 10, inclusive, and $CF(CF_3)[OCF_2CF(CF_3)]_zOC_3F_7$, where z is zero or an integer from 1 to 10, inclusive.

Procedures for preparing the benzimidazole additives in which R is hydrogen, hydrocarbon alkyl, hydrocarbon aryl and perfluoroalkyl are described in the literature, e.g., in Elderfield's "Heterocyclic Compounds," John Wiley and Sons, New York, N.Y. An exemplary procedure disclosed in the literature for preparing various 2-substituted benzimidazoles can be represented by the following formulas:

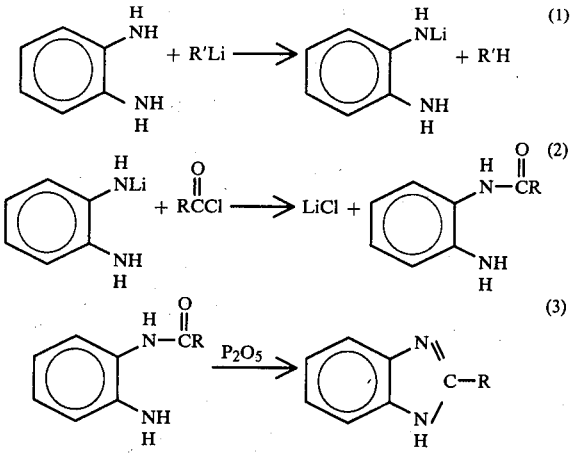

In equation (1), R'Li can be any suitable organolithium compound, e.g., one in which R' is $CH_3$—, $C_4H_9$—or $C_6H_5$—. As seen from equation (2), the acid chloride $$\overset{O}{\overset{\|}{RCCl}}$$

is the source of the R group, which can be, for example, a hydrocarbon alkyl, a hydrocarbon aryl or perfluoroalkyl group.

A procedure described in the literature for preparing 2-substituted benzimidazoles in which R is hydrocarbon alkyl can be represented by the following equation:

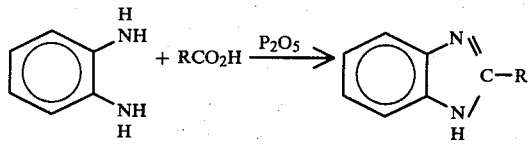

As seen from the equation, o-diaminobenzene is reacted directly with an aliphatic acid to give the benzimidazole.

The benzimidazoles in which R is a perfluoroalkyleneether radical are new compounds which can be prepared by a process which is not described in the literature. The process involved in their preparation is illustrated by the following equation:

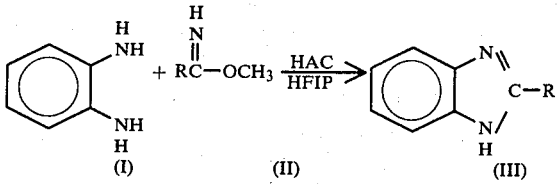

As shown by the foregoing equation, o-diaminobenzene (I) is reacted with imidate ester (II) in the presence of glacial acetic acid (HAC), utilizing hexafluoroisopropanol (HFIP) as the reaction medium. The reaction temperature usually ranges from about 45° to 50° C.

The reaction time usually ranges from about 1 hour to 4 or 5 days.

It is seen from the foregoing equation that the R group is derived from the imidate ester (II). The imidate esters are well known compounds that are described in the literature. For example, following the procedure described by H. C. Brown and C. R. Wetzel in Journal of Organic Chemistry, 30, 3724 (1965), a variety of imidate esters can be synthesized from a variety of fluorine-containing nitriles. While the process is particularly suitable for preparing 2-substituted benzimidazole additives in which R is a perfluoroalkyleneether as described above, it can also be employed to synthesize benzimidazoles in which R is a perfluoroalkyl ($C_aF_{2a+1}$). A more complete discussion of the synthesis of the fluorine-containing benzimidazoles can be obtained by referring to our copending U.S. application Ser. No. 100,301, filed on Dec. 4, 1979, the disclosure of which is incorporated herein by reference.

A more comprehensive understanding of the invention can be obtained by referring to the following illustrative examples which are not intended, however, to be unduly limitative of the invention.

EXAMPLE I

A series of runs was carried out in which grease compositions of this invention were formulated and tested. As a base fluid there was used a polyfluoroalkylether having the following formula:

$$C_3f_7O(\underset{\underset{CF_3}{|}}{C}FCF_2O)_nC_2F_5,$$

where n is an integer having a value such that the fluid has a kinematic viscosity of 270 centistokes at 100° F. The base fluid was Krytox 143AC fluid, a product of E. I. duPont de Nemours and Company, Wilmington, Del. The thickener used was a fluorinated copolymer of ethylene and propylene having a molecular weight of about 150,000.

The benzimidazole additives used in the formulations had the following structural formula:

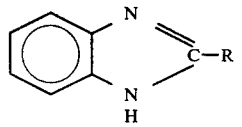

in which R was one of the following: H, $C_6H_{13}$, $C_6H_5$, $CF(CF_3)OCF_2—CF(CF_3)OC_3F_7$, and $CF(CF_3)[OCF_2CF(CF_3)]_4OC_3F_7$.

In preparing the greases, the components were mixed and stirred until a uniform mixture was obtained. The amounts of base fluid used range from 65 to 72 weight percent while the amounts of thickener ranged from 27 to 34 weight percent. Each grease composition contained 1.0 weight percent of one of the above-described benzimidazole additives. Each mixture was further blended to a grease consistency by passing it two times through a 3-roll mill with the rollers set at an opening of 0.002" at about 77° F.

The several grease compositions were tested according to several standard test procedures. The penetration test was conducted in accordance with Federal Test Method Standard 791*a*, Method 313.2. The rust preventive properties test was carried out in accordance with Method 4012 of the same standard. The high temperature corrosion was determined in accordance with the method set forth in Technical Documentary Report AFML-TR-69-290. The results of the tests are set forth hereinafter in the table.

EXAMPLE II

A series of runs was conducted in which greases were prepared, utilizing, as described in Example I, the same thickener and benzimidazole additives and amounts thereof as well as the same amounts of a polyfluoroalkylether base fluid. However, the polyfluoroalkylether had the following structural formula:

$$X—O—(—C_3F_6O)_P—(CF_2—O)_Q—(—C_2F_4—O)_S—Y,$$

where X and Y are $CF_3$, $C_2F_5$, or $C_3F_7$ and P, Q and S are integers such that the fluid has a kinematic viscosity of about 90 centistokes at 100° F. The base fluid used was Fomblin Y fluid, a product of Montedison, S.p.A., Milan, Italy.

The greases were formulated and tested according to the procedures described in Example I. The results of the tests are shown below in the Table.

EXAMPLE III

A series of runs was conducted in which greases were prepared, utilizing, as described in Example I, the same thickener and benzimidazole additives and amounts thereof as well as the same amounts of a polyfluoroalkylether base fluid. However, the polyfluoroalkylether had the following structural formula:

$$R_fO(CF_2CF_2O)_x(CF_2O)_yR_f;$$

wherein $R_f$ is $CF_3$ or $C_2F_5$, and x and y are integers whose values are such that the compound has a kinematic viscosity of about 130 centistokes at 100° F. The base fluid used was Brayco 815z fluid, a product of Bray Oil Co., Los Angeles, Calif.

The greases were formulated and tested according to the procedures described in Example I. The results of the tests are shown hereinafter in the table.

EXAMPLE IV

A series of runs was conducted in which greases were prepared, utilizing, as described in Example I, the same base fluid and benzimidazole additives and amounts thereof as well as the same amount of a thickener. However, the thickener was polytetrafluoroethylene having a molecular weight of about 30,000.

The greases were formulated and tested according to the procedures described in Example I. The results of the test are shown below in the table.

EXAMPLE V

A series of runs was carried out in which greases were prepared, utilizing, as described in Example II, the same base fluid and benzimidazole additives and amounts thereof as well as the same amount of thickener. However, the thickener used was polytetrafluoroethylene having a molecular weight of about 30,000.

The greases were formulated and tested according to the procedures described in Example I. The results of the tests are set forth below in the table.

EXAMPLE VI

A series of runs was conducted in which greases were prepared, utilizing, as described in Example III, the same base fluid and benzimidazole additives and amounts thereof as well as the same amount of thickener. However, the thickener used was polytetrafluoroethylene having a molecular weight of about 30,000.

The greases were formulated and tested according to the procedures described in Example I. The results of the tests are shown below in the table.

EXAMPLE VII

Control runs were carried out in which greases were prepared, utilizing the base fluids and thickeners of Examples I, II, and III. The greases consisted of 70 weight percent base fluid and 30 weight percent thickener and did not contain any benzimidazole additives.

The greases were formulated and tested according to the procedures described in Example I. The results of the tests are included below in the table.

The following examples; namely, examples

EXAMPLE VIII 65.0% Fluid given in Example I
33.5% Thickener given in Example I
1.5% Benzimidazole wherein R is H
Penetration—264

EXAMPLE IX 65.0% Fluid given in Example II
33.5% Thickener given in Example II
1.5% Benzimidazole wherein R is $C_6H_{13}$
Penetration—283

EXAMPLE X 65.0% Fluid given in Example III
33.5% Thickener given in Example III
1.5% Benzimidazole wherein R is $C_6H_5$
Penetration—295

EXAMPLE XI 65.0% Fluid given in Example IV
33.5% Thickener given in Example IV
1.5% Benzimidazole wherein R is $CF(CF_3)OCF_2CF(CF_3)OC_3F_7$
Penetration—265

EXAMPLE XII 65.0% Fluid given in Example V
33.5% Thickener given in Example V
1.5% Benzimidazole wherein R is $CF(CF_3)[OCF_2CF(CF_3)]_4OC_3F_7$
Penetration—283

EXAMPLE XIII 65.0% Fluid given in Example VI
33.5% Thickener given in Example VI
1.5% Benzimidazole wherein R is $C_6H_5$
Penetration—296

TABLE

| Greases | Penetra-(1) tion, decil-millimeters | Rust(2) Pre-ventive Pro-perties | High Temperature Corrosion(4) 450° F., 72 hours 52-100 steel | 440C steel | M-10 steel | M-50 steel |
|---|---|---|---|---|---|---|
| Example I | 264-277 | Pass(3) | Pass | Pass | Pass | Pass |

TABLE-continued

| Greases | Penetra-(1) tion, decil-millimeters | Rust(2) Pre-ventive Pro-perties | High Temperature Corrosion(4) 450° F., 72 hours 52-100 steel | 440C steel | M-10 steel | M-50 steel |
|---|---|---|---|---|---|---|
| Example II | 283-300 | Pass | Pass | Pass | Pass | Pass |
| Example III | 295-300 | Pass | Pass | Pass | Pass | Pass |
| Example IV | 265-277 | Pass | Pass | Pass | Pass | Pass |
| Example V | 283-303 | Pass | Pass | Pass | Pass | Pass |
| Example VI | 296-300 | Pass | Pass | Pass | Pass | Pass |
| Based on 270(6) cs fluid | 298-300 | Fail(5) | Fail | Fail | Fail | Fail |
| Based on 90(6) cs fluid | 310-310 | Fail | Fail | Fail | Fail | Fail |
| Based on 130(6) cs fluid | 292-292 | Fail | Fail | Fail | Fail | Fail |

(1)Range of penetration values of the various greases formulated in Examples.
(2)Federal Test Method Standard 791a, Method 4012.
(3)Pass - No rusting or corrosion, a maximum of 3 spots allowed.
(4)AFML-TR-69-290.
(5)Fail - More than 3 rust or corroded spots or pitting and etching.
(6)Control runs.

As seen from the data in the foregoing table, the grease compositions of this invention do not cause rusting of ferrous metals under mild temperature and high humidity conditions or corrosion under conditions of high temperature. The antirust and anticorrosion properties of the greases are directly attributable to the presence of the benzimidazole additives. Thus, when the additives were omitted as in the control runs, rusting and corrosion of the ferrous metals occurred as a result of contact with greases based on polyfluoroalkylether fluids.

As will be evident to those skilled in the art, modifications of the present invention can be made in view of the foregoing disclosure without departing from the spirit and scope of the invention.

We claim:

1. A grease composition comprising a major amount of a polyfluoroalkylether base fluid, a minor amount of a thickening agent for the base fluid, and a rust and corrosion inhibiting amount of a benzimidazole having the following structural formula:

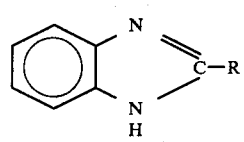

wherein R is hydrogen, hydrocarbon alkyl, hydrocarbon aryl, perfluoroalkyl or perfluoroalkyleneether.

2. The grease composition according to claim 1 in which the polyfluoroalkylether base fluid is a compound selected from the group of compounds having the following formulas:

$$C_3F_7O(\underset{\substack{|\\ CF_3}}{CFCF_2O})_nR', \quad (a)$$

in which R′ is a perfluoroalkyl group containing 2 or 3 carbon atoms, and n is an integer ranging from 5 to 50, inclusive;

$$X—O—(—C_3F_6—O)_p(—CF_2—O)_q(—C_2F_4—O—)_s—Y, \quad (b)$$

in which P, Q and S are average indices of composition and only P and/or S can be zero, the sum of P+Q+S has a value between 2 and 200, the ratio P/Q+S has a value of from 0 to 50, the ratio S/Q has a value of from 0 to 10, X and Y are terminal groups selected from the group consisting of $-CF_3$, $-C_2F_5$, $-C_3F_7$ and $$-\underset{\underset{CF_3}{|}}{CF}-O-CF_3,$$

provided that both terminal groups X and Y are $-CF_3$ when both indices P and S are equal to zero, the terminal groups are the same or different from each other and are selected from the group consisting of $-CF_3$ and $-C_2F_5$ when only index P is zero, and when P is different from zero, the two terminal groups are the same or different from each other and selected from the group consisting of $-CF_3$, $-C_2F_5$ and $-C_3F_7$, or one of the terminal groups may be $$CF_3-O-\underset{\underset{CF_3}{|}}{CF}-;$$

and $$R_fO(CF_2CF_2O)_x(CF_2O)_yR_f; \qquad (c)$$

in which $R_f$ is $CF_3$ or $C_2F_5$, x and y are integers whose sum is between 2 and 200 and the ratio of y to x is between 0.1 and 10.

3. The grease composition according to claim 2 in which the thickening agent is a fluorinated ethylene-propylene copolymer or polytetrafluoroethylene.

4. The grease composition according to claim 3 which comprises about 65 to 72 weight percent of the base fluid, about 26.5 to 34.5 weight percent of the thickening agent, and about 0.5 to 1.5 weight percent of the benzimidazole, based upon a total of 100 weight percent.

5. The grease composition according to claim 4 in which R is hydrogen.

6. The grease composition according to claim 4 in which R is a hydrocarbon alkyl.

7. The grease composition according to claim 6 in which the hydrocarbon alkyl is $C_6H_{13}$.

8. The grease composition according to claim 4 in which R is a hydrocarbon aryl.

9. The grease composition according to claim 8 in which the hydrocarbon aryl is $C_6H_5$.

10. The grease composition according to claim 4 in which R is perfluoroalkyl.

11. The grease composition according to claim 10 in which the perfluoroalkyl is $C_3F_7$.

12. The grease composition according to claim 4 in which R is perfluoroalkyleneether.

13. The grease composition according to claim 12 in which the perfluoroalkyleneether is $CF(CF_3)OCF_2CF(CF_3)OC_3F_7$.

14. The grease composition according to claim 12 in which the perfluoroalkyleneether is $CF(CF_3)[OCF_2CF(CF_3)]_4OC_3F_7$.

* * * * *